US005096315A

United States Patent [19]

Yamamoto et al.

[11] Patent Number: 5,096,315

[45] Date of Patent: Mar. 17, 1992

[54] INK RIBBON WINDING MECHANISM

[75] Inventors: Toshiyuki Yamamoto, Takizawa; Toshiaki Amano, Iwate, both of Japan

[73] Assignee: Alps Electric Co., Ltd., Tokyo, Japan

[21] Appl. No.: 455,192

[22] Filed: Dec. 20, 1989

[30] Foreign Application Priority Data

Feb. 2, 1989 [JP] Japan ..... 1-11530[U]
Feb. 23, 1989 [JP] Japan ..... 1-21151[U]

[51] Int. Cl.[5] ..... B41J 33/20

[52] U.S. Cl. ..... 400/221.2; 400/222; 400/236.2

[58] Field of Search ..... 400/218, 221, 221.1, 400/221.2, 222, 236.2, 232, 227.2

[56] References Cited

U.S. PATENT DOCUMENTS

| | | | |
|---|---|---|---|
| 3,854,670 | 12/1974 | Bertolazzi | 400/221 |
| 3,976,183 | 8/1976 | Fleischmann et al. | 400/227.2 |
| 4,008,795 | 2/1977 | Garberi et al. | 400/221.2 |
| 4,342,520 | 8/1982 | Isobe et al. | 400/221 |
| 4,353,658 | 10/1982 | Craft | 400/227.2 |
| 4,609,299 | 9/1986 | Hattori et al. | 400/236.2 |
| 4,652,154 | 3/1987 | Horiya et al. | 400/227.2 |
| 4,712,115 | 12/1987 | Tasumi et al. | 400/218 |
| 4,723,853 | 2/1988 | Suzaki et al. | 400/222 |
| 4,775,869 | 10/1988 | Minowa | 346/76 PH |
| 4,839,742 | 6/1989 | Nakatani et al. | 400/208 |

FOREIGN PATENT DOCUMENTS

| | | | |
|---|---|---|---|
| 2736040 | 2/1979 | Fed. Rep. of Germany | 400/221 |
| 0178887 | 11/1982 | Japan | 400/221.2 |
| 0016882 | 1/1983 | Japan | 400/221 |
| 0262681 | 12/1985 | Japan | 400/236.2 |
| 0195880 | 8/1986 | Japan | 400/227.2 |
| 0064785 | 3/1988 | Japan | 400/236.2 |
| 0125383 | 5/1988 | Japan | 400/236.2 |
| 0821219 | 4/1981 | U.S.S.R. | 400/222 |

OTHER PUBLICATIONS

IBM Technical Disclosure Bulletin, vol. 19, No. 12, May 1977, Clutched Planetary Ball Drive System . . . .

*Primary Examiner*—Edgar S. Burr
*Assistant Examiner*—John S. Hilten
*Attorney, Agent, or Firm*—Guy W. Shoup; David W. Heid

[57] ABSTRACT

The present invention relates to an ink ribbon winding mechanism for a printer which prints with an ink ribbon. It is constructed by disposing a ribbon winding gear, which is connected with an ink ribbon winding shaft through a slipping mechanism, and a detection driving gear for detecting markers for color identification for a color ink ribbon, which is connected directly with the winding shaft, and by locating a transmission gear for transmitting the driving force of a driving source selectively to these two gears between the driving source driving the ink ribbon winding shaft and the winding gear as well as the detection driving gear. The marker for color identification are detected correctly by directly transmitting the driving force from the driving source to the ribbon winding shaft at the detetion of the markers in the color ink ribbon.

8 Claims, 3 Drawing Sheets

INK RIBBON WINDING MECHANISM

BACKGROUND OF THE INVENTION

1. Field of the Invention

The present invention relates to an ink ribbon winding mechanism, and in particular to an ink ribbon winding mechanism suitable for winding a multi-colored ink ribbon, on which inks of different colors are applied, and detecting correctly markers for color identification formed in the ink ribbon.

2. DESCRIPTION OF THE PRIOR ART

Prior art printers are so constructed that desired printing is effected, in general, by transferring the ink applied on the ink ribbon to a sheet of paper by means of a printing head having a printing element consisting of a plurality of dots.

FIG. 7 shows a prior art printer of this kind generally utilized. A plate-shaped platen 2 is so disposed nearly at the central portion of a frame 1 of the printer that the printing face thereof is approximately vertical and a carriage shaft 3 is disposed so as to be parallel to the platen 2 stated above downward before the platen 2 of the frame 1 described above. Further, there is formed a flange-shaped guide portion 4 at the front edge of the frame 1 and a carriage 5 is mounted movably forward and backward along the carriage shaft 3 and the guide portion 4 on the carriage shaft 3 and the guide portion 4. A printing head 6 is mounted on the extremity of the carriage 5 so as to be opposite to the platen 2 described above and a ribbon cassette (not shown in the figure) is mounted, in which the ink ribbon is located and which guides this ink ribbon between the printing head 6 and the platen 2.

Further, on the carriage 5, there is disposed a winding mechanism 7. As indicated in FIGS. 8 and 9, this winding mechanism 7 has a winding shaft 8. On the lower end portion of this winding shaft 8, a supporting flange 9 protruding outward is formed in one body, and at the same time the shaft is inserted in a winding gear 10, which is mounted rotatably, independently of the winding shaft 8 described above. Still further, a piece of felt 11 acting as a slipping mechanism is disposed between the lower surface of the winding gear 10 and the supporting flange 9 of the winding shaft 8. To the upper end portion of the winding shaft 8, there is secured a winding bobbin 12 engaged with a winding hole (both not shown in the figure) formed in the ribbon cassette, exposed on the upper surface of the carriage 5. On the outer peripheral surface of this winding bobbin 12, there are formed 3 engaging nails 13 at positions driving equally the periphery into 3 so as to protrude therefrom and on the lower surface of the winding bobbin 12, there is formed a ring-shaped holding groove 14. An energizing spring 15 is disposed on the outer periphery of the winding shaft 8, whose upper end portion is held in the holding groove 14 formed in the winding bobbin 12 and whose lower end portion is contacted with the upper surface of the winding gear described above so that the winding gear 10 is contacted with the supporting flange 9 of the winding shaft 8 through the piece of felt 11 described above with pressure owing to the energizing force of this energizing spring 15.

Still further, a driving gear 18 secured to the rotating shaft 17 of a ribbon winding motor 16 is engaged with the winding gear 10 so that the driving gear 18 is rotated by driving to rotate the ribbon winding motor 16 and thus the winding gear 10 is rotated. In this way, this rotational driving force is transmitted to the winding shaft 8 through the frictional force of the piece of felt 11 produced by the energizing force of the energizing spring 15 mounted on the winding gear 10.

Still further, behind the platen 2 stated above, there is formed a sheet insertion opening 19 for forwarding a sheet of paper (not shown in the figure) towards the platen 2, and in the proximity of the sheet insertion opening 19, there is disposed a sheet forwarding roller 20 for forwarding the sheet of paper with a predetermined speed. Under this sheet forwarding roller 20, there is disposed rotatably a with-pressure-contacted roller 21 contacted with pressure with this sheet forwarding roller 20 so that the sheet of paper inserted through the sheet insertion opening 19 is put between the sheet forwarding roller 20 and the with-pressure-contacted roller 21 to be forwarded.

In the prior art printer described above, the sheet of paper is inserted through the sheet insertion opening 19 so as to be put between the sheet forwarding roller 20 and the with-pressure-contacted roller 21 and forwarded with the predetermined speed in the direction perpendicular to the movement direction of the carriage 5 by driving the sheet forwarding roller 20 so as to be rotated by means of the stepping motor. On the other hand, the ribbon winding motor 16 is driven at the same time as the drive of the carriage 5 described above and the winding shaft 8 is rotated through the winding gear 10. In this way, desired printing is effected on the sheet of paper by driving the printing head 6 on the basis of desired printing signals while winding the ink ribbon by rotating the winding bobbin 12.

Further, in the case where a multi-colored ink ribbon, on which inks of a plurality of colors are applied, is used as the ink ribbon located in the ribbon cassette stated above, either as indicated in FIG. 10(*a*), there are disposed markers 23 having different sizes in the longitudinal direction for different colors at boundary portions of the different colors, which are e.g. yellow (Y), magenta (M) and cyan (C), on the ink ribbon 22, or as indicated in FIG. 10(*b*), there are disposed markers 23 having numbers of lines different for different colors at the boundary portions of the different colors. When it is desired to detect the different colors in this ink ribbon 22, the different colors are detected by reading out the markers stated above while winding the ink, ribbon by driving the ribbon winding motor 16 to rotate the winding bobbin 12, just as at winding the ink ribbon, neither the carriage 5 nor the printing head 6 being driven.

However, in the prior art ink ribbon winding mechanism described above, in the case where the colors of the multi-colored ink ribbon are detected, the winding shaft 8 is rotated through the winding gear 10 and the piece of felt 11, if the load at the winding of the ink ribbon exceeds the frictional force produced when the winding gear 10 is contacted with pressure with the supporting flange 9 by means of the energizing spring 15, sliding takes place between the winding gear 10 and the winding shaft 8 and therefore it has a problem that fluctuations are produced in the rotation of the winding shaft 8. Because of these fluctuations in the rotation of the winding shaft 8, since the displacement speed of the markers in the ink ribbon is varied, it has another problem that it is impossible to detect the markers, or erroneous colors are detected.

SUMMARY OF THE INVENTION

The present invention has been done in view of these problematical points and an object of the present invention is to provide an ink ribbon winding mechanism, which can prevent the fluctuations in the rotation of the winding shaft at the detection of the markers in the ink ribbon so that the markers are surely detected.

Another object of the present invention is to provide an ink ribbon winding mechanism, in which a winding bobbin engaged with a winding hole formed in a ribbon cassette is secured to the upper end portion of a winding shaft and the winding shaft is coupled with winding driving means, which driven by a ribbon winding driving source so as to be rotated, through a slipping mechanism, wherein detection driving means for detecting markers formed in the ink ribbon is secured to the winding shaft and there is disposed transmission means for transmitting the rotational driving force of the ribbon winding driving source between the ribbon winding driving source and the winding driving means as well as the detection driving means, which means is engaged selectively with the winding driving means at the usual winding of the ink ribbon and with the detecting driving means at the detection of the markers in the ink ribbon.

According to the present invention, since the predetermined markers in the ink ribbon are detected by rotating the winding bobbin owing to the fact that the transmission means is engaged selectively with the detection driving means so that the rotational driving force of the ribbon winding driving source is transmitted directly to the detection driving means, even in the case where a rotational load is imposed on the ink ribbon, the winding shaft is never slipped so that it is possible to prevent the generation of the fluctuations in the rotation of the winding shaft and to detect surely the marker in the ink ribbon.

BRIEF DESCRIPTION OF THE DRAWINGS

FIG. 5(*a*) and (*b*) being a longitudinal cross-sectional view and a plan view, respectively, of an ink ribbon winding core for plain paper, FIG. 6(*a*) and (*b*) being a longitudinal cross-sectional view and a plan view, respectively, of an ink ribbon winding core for OHP sheet;

DETAILED DESCRIPTION OF THE PREFERRED EMBODIMENTS

Figure 1:
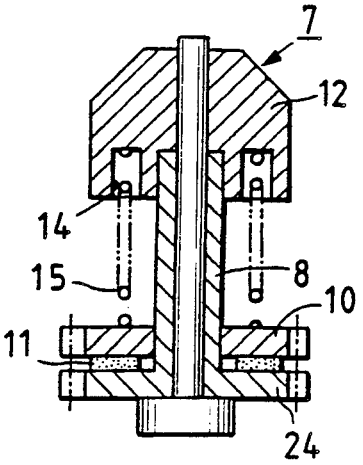
FIGS. 1 and 2 indicate an embodiment of the ink ribbon winding mechanism according to the present invention, FIG. 1 being a longitudinal cross-sectional view of the winding shaft, FIG. 2 being a perspective view thereof.

Hereinbelow the embodiments of the present invention will be explained, referring to the drawings.

Figure 2:
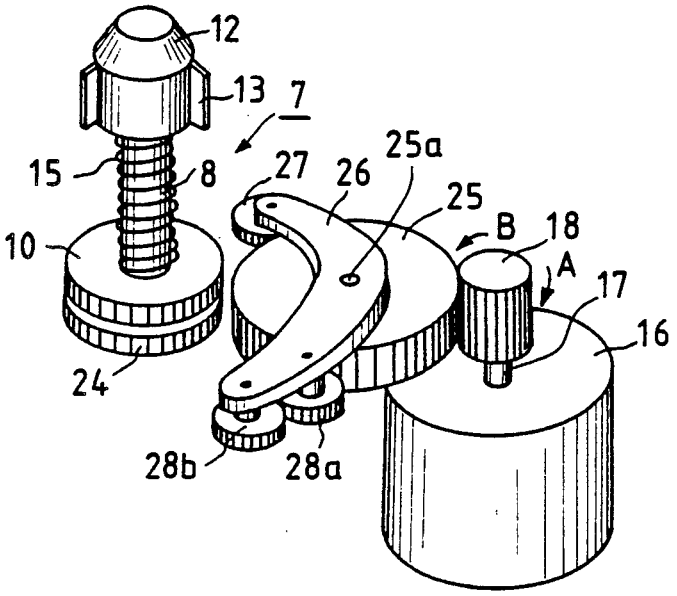

FIGS. 1 and 2 indicate an embodiment of an ink ribbon winding mechanism according to the present invention, in which the items identical to those in the prior art mechanism are indicated by the same reference numerals.

In the present embodiment, a detection driving gear 24 protruding outward is formed in one body on the lower end portion of the winding shaft 8 instead of the supporting flange and this winding shaft 8 is inserted in the winding gear 10 serving as driving means, which is mounted rotatably, independently of the winding shaft 8 described above. Further, to the upper end portion of the winding shaft 8, there is secured a winding bobbin !2 engaged with the winding hole (not shown in the figure) formed in the ribbon cassette. The energizing spring 15 is disposed between this winding bobbin 12 and the winding gear 10 stated above, which spring makes the winding gear 10 contact with pressure with a gear 24 serving as the detection driving means through the piece of felt 11.

Still further, the driving gear 18 is secured to the rotating shaft 17 of the motor 16 serving as the ribbon winding driving source and a main transmission gear 25 having a great diameter is engaged with this driving gear 18. An arc-shaped pivoting arm 26 is mounted pivotably on the upper end portion of the rotating shaft 25*a* of this main transmission gear 25. A winding auxiliary transmission gear 27 is mounted rotatably on one end portion (upper end portion in FIG. 2) of this pivoting arm 26, which gear is engaged with the main transmission gear 25 and with the winding gear 10 by a counterclockwise pivoting of the pivoting arm 26. Still further, two detection driving auxiliary transmission gears 28*a* and 28*b* are mounted rotatably on the other end portion of the pivoting arm 26, which gears are engaged with the main transmission gear 25 stated above and with the detection driving gear 24 stated above by a clockwise pivoting of the pivoting arm 26.

Now the operation of the present embodiment will be explained.

At first, in the case where a usual winding of the ink ribbon is effected at a usual printing, the ribbon winding motor !6 is driven so that the driving gear 18 is rotated in the direction indicated by an arrow A (clockwise) in FIG. 2. In this way, the main transmission gear 25 is rotated counterclockwise and the rotation of this main transmission gear 25 is transmitted to the pivoting arm 26 through the winding auxiliary transmission gear 27 and the inner detection driving auxiliary transmission gear 28*a*. At the same time, the pivoting arm 26 is pivoted counterclockwise together with the winding auxiliary transmission gear 27 so that the winding auxiliary transmission gear 27 is engaged with the winding gear 10. In this way, the winding gear 10 is driven so as to be rotated, and at the same time the rotational force is transmitted to the winding shaft 8 through the frictional force of the piece of felt 11 described above. In this way, the winding bobbin 12 is rotated so that the winding of the ink ribbon is effected.

Furthermore, in the case where the markers in the ink ribbon are detected, the ribbon winding motor 16 stated above is driven so as to be rotated in the reverse direction so that the driving gear 18 is driven so as to be rotated in the direction indicated by an arrow B in FIG. 2. Together therewith, the pivoting arm 26 stated above is pivoted clockwise. In this way, the engagement of the winding auxiliary transmission gear 27 with the winding gear 10 is removed and the detection driving auxiliary transmission gear **28*b* is engaged with the detection driving gear 24. Thus the detection driving gear 24 is driven directly through the main transmission gear 25 as well as the detection driving auxiliary transmission gears 28*a* and 28*b* so as to be rotated and the winding bobbin 12** is rotated so that the predetermined markers in the ink ribbon are detected.

Consequently, in the present embodiment, in the case where the markers in the ribbon are detected, since the rotational force is transmitted directly from the ribbon winding motor 16 through the main transmission gear 25, the detection driving auxiliary transmission gears **28*a* and 28*b* and the detection driving gear 24, even if a rotational load is imposed on the ink ribbon, the winding shaft 8 is never slipped. In this way, it is possible to prevent generation of fluctuation in the rotation of the winding shaft 8** and thus to detect surely the markers in the ink ribbon. Therefore, it is possible to effect always suitable color printing. Although in the present embodiment an example is shown in which gears are used as different driving means, the mechanism may be so constructed that apart therefrom e.g. rollers such as gum rollers are used as driving means and the driving force from the driving source is transmitted by the frictional force thereof.

Next, another embodiment of the present embodiment will be explained, referring to FIGS. 3 and 4. The present embodiment shows an example of the case where the present invention is applied to the ink ribbon winding mechanism for a printer, which is so constructed that different ink ribbons are used, depending on the kind of the sheet on which printing is to be effected, e.g. OHP sheet (sheet for over-head projector) and plain paper.

In such a printer, in the case where one of them, an ink ribbon for OHP sheet is used, the ink ribbon is peeled off when it is cold, and in the case where the other of them, an ink ribbon for plain paper is used, the ink ribbon is peeled off when it is hot, and characteristics of the used inks themselves are also different. For this reason, load at the peeling off varies, depending on the kind of ink ribbons. That is, since the load necessary for peeling off the ink ribbon for plain paper is greater than the load necessary for peeling off the ink ribbon for OHP sheet, the mechanism is so constructed that the winding torque can be varied, depending on the kind of the used ink ribbons.

Figure 3:
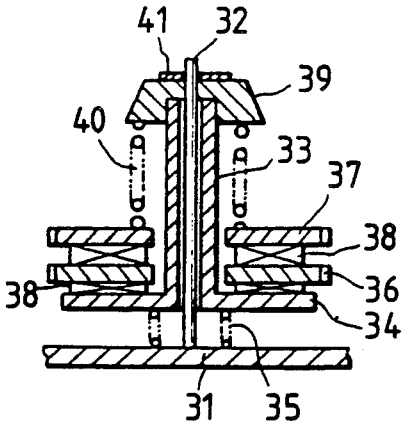
FIGS. 3 to 6 indicate another embodiment of the ink ribbon winding mechanism according to the present invention, FIG. 3 being a longitudinal cross-sectional view of the winding shaft portion, FIG. 4 being a perspective view thereof.
Figure 4:
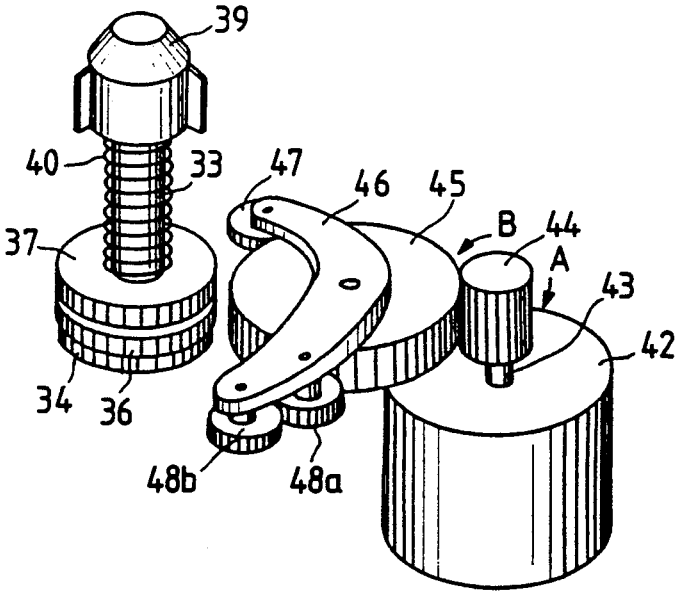

FIGS. 3 and 4 show the other embodiment of the present invention. A supporting shaft 32 is secured to the upper surface of a carriage 31. On the outer periphery of this supporting shaft 32, there is disposed a winding shaft 33 rotatably and movably up and down along the supporting shaft 32. A detection driving gear 34 is formed in one body on the lower end portion, which is the ground portion of the winding shaft 33, which gear protrudes outward instead of the supporting flange. A pushing up spring 35, which energizes upward the winding shaft 33, is disposed on the lower surface of the winding shaft 33. The portion of the winding shaft 33 over the detection driving gear 34, i.e. the extremity side thereof in the axial direction, is inserted in a winding gear for plain paper 36 and a winding gear for OHP sheet 37 so that they are rotatable around it, independently from each other. Pieces of felt 38 and 38 are put between the detection driving gear 34 and the winding gear for plain paper 36 and between the winding gear for plain paper 36 and the winding gear for OHP sheet 37, respectively. Further, a winding bobbin 39 engaged with the winding core in the ribbon cassette is secured to the extremity portion of the winding shaft 33. Between this winding bobbin 39 and the winding gear for OHP sheet 37, there is disposed an engaging spring 40, which makes the winding gears 36 and 37 contact with pressure with the detection driving gear 34 through the pieces of felt 38, 38. Still further, a stopper 41 is mounted on the upper surface of the winding bobbin 39.

Still further, a winding gear 44 is secured to the rotating shaft 43 of a ribbon winding motor 42 and a main transmission gear 45 having a great diameter is engaged with this driving gear 44. A pivoting arm 46 is mounted pivotably coaxially on this main transmission gear 45. A winding auxiliary transmission gear 47 is mounted rotatably on one end portion (upper end portion in FIG. 4) of this pivoting arm 46, which gear is engaged with the main transmission gear 45 and engaged with the winding gears 36 and 37 by a counterclockwise pivoting of the pivoting arm 46 stated above. Still further, a series of two toothed-wheel-shaped detection driving auxiliary transmission gears **48*a* and 48*b* are mounted rotatably on the other end portion of the pivoting arm 46, which gears are engaged with the main transmission gear 45 and engaged with the detection driving gear 34 stated above by a clockwise pivoting of the pivoting arm 46**.

Figure 5A:
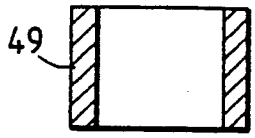
Figure 5B:
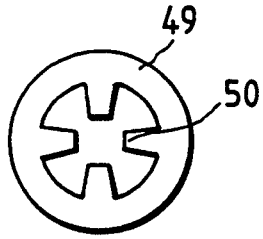
Figure 6A:
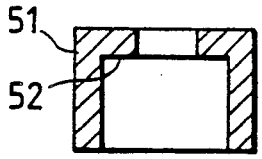
Figure 6B:
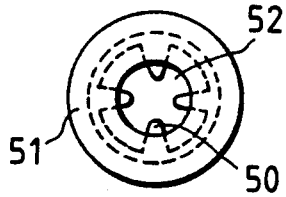
Figure 7:
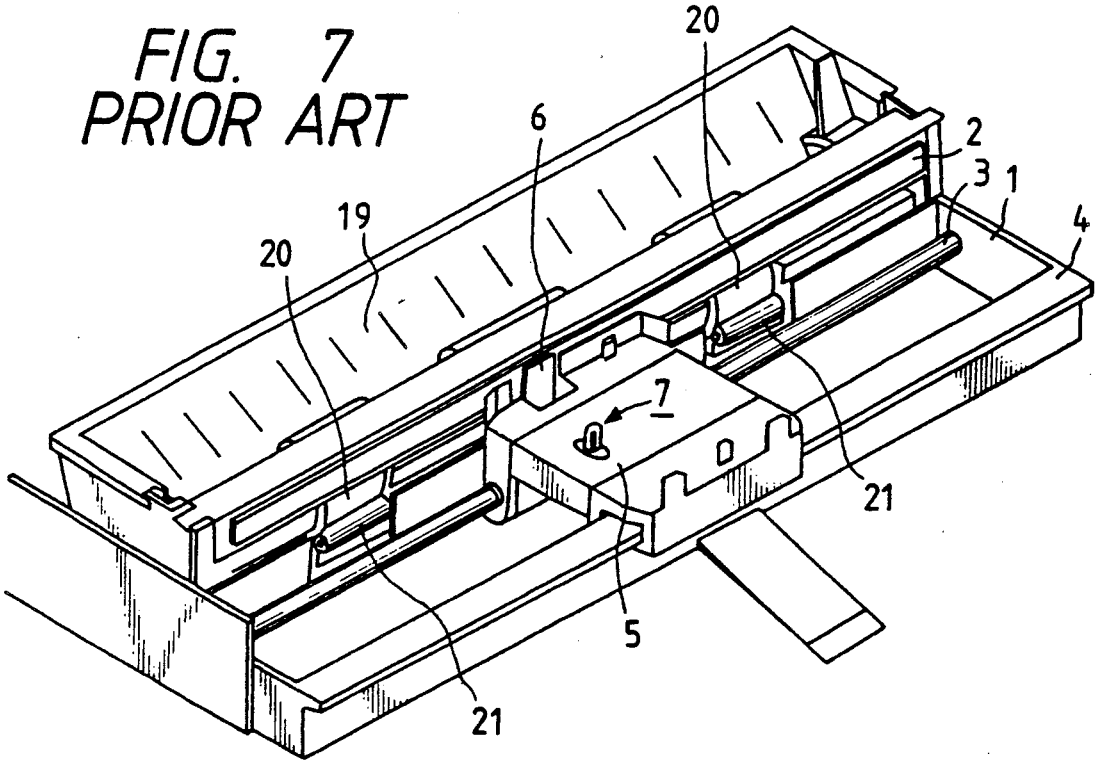
FIG. 7 PRIOR ART
FIG. 7 is a perspective view indicating a prior art general printer.
Figure 8:
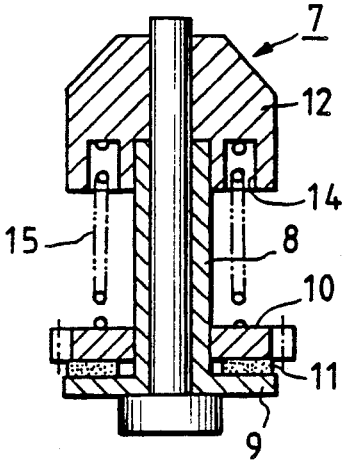
FIG. 8 PRIOR ART
FIG. 8 is a longitudinal cross-sectional view of the winding shaft portion in a prior art winding mechanism.
Figure 9:
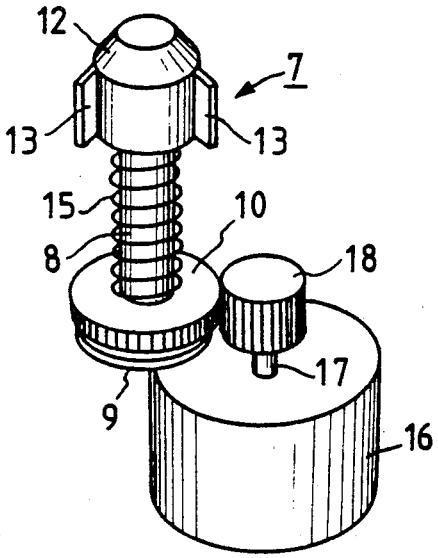
FIG. 9 PRIOR ART
FIG. 9 is a perspective view of the prior art winding mechanism.
Figure 10A:
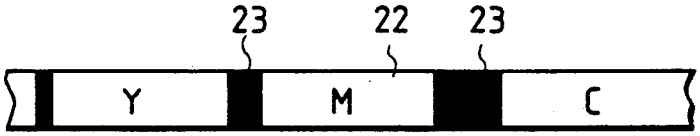
FIGS. 10(*a*) and (*b*) are schemes for explaining ink ribbons, in which different markers for color identification are formed.
Figure 10B:
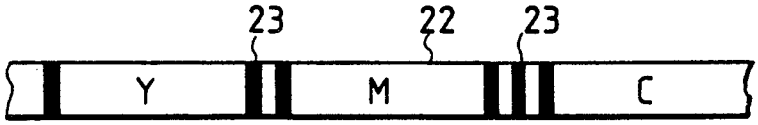

Still further, the winding core for plain paper 49 of the ribbon cassette, in which the ink ribbon for plain paper is located, has a cylindrical shape, as indicated in FIG. 5, and on the inner peripheral surface of this winding core 49, there are formed engaging protrusion 50 engaged with the winding bobbin 39. On the other hand, the winding core for OHP sheet 51 has a cylindrical shape, on the inner peripheral surface of which there are formed similarly engaging protrusions 50, as indicated in FIG. 6. On the inner side of the upper end portion of this winding core 51, there is formed a ring-shaped pushing down ring portion 52, which is brought into contact with the shoulder portion of the winding bobbin 39 for pushing down the winding shaft 33. In this way, in the state where the carriage 31 is loaded with the ribbon cassette, in which the ink ribbon for plain paper is located, the winding core 49 is engaged with the winding bobbin 39 and the winding auxiliary transmission gear 47 is engaged with the winding gear for plain paper 36. Further, when the carriage 3i is loaded with the ribbon cassette, in which the ink ribbon for OHP sheet is located, the pushing down ring portions 52 of the winding core 51 is brought into contact with the shoulder portion of the winding bobbin 39 and pushes down the winding bobbin 39 and the winding shaft 33. In this way, the winding gear for OHP sheet 37 is engaged with the winding auxiliary transmission gear 47.

Now the operation of the present embodiment will be explained.

At first, in the case where the ink ribbon for plain paper is rewound, the carriage 31 is loaded with the ribbon cassette, in which the ink ribbon for plain paper is located, and the winding core 49 is engaged with the winding bobbin 39. Then the ribbon winding motor 42 is driven. In this way, the main transmission gear 45 is rotated counterclockwise by rotating the driving gear 44 in the direction indicated by an arrow A in FIG. 4. At the same time, the pivoting arm 46 is pivoted counterclockwise and the winding auxiliary transmission gear 47 stated above is engaged with the winding gear for plain paper 36. In this way, the winding gear for plain paper 36 is driven so as to be rotated. Thus the rotational driving force is transmitted to the winding shaft 33 through the frictional force of a piece of felt 38 by rotating the winding gear for plain paper 36 stated above to rotate the winding bobbin 39 so that the ink ribbon for plain paper is rewound.

On the contrary, in the case where the ink ribbon for OHP sheet is rewound, the pushing down ring portion 52 of the winding core is brought into contact with the shoulder portion of the winding bobbin by loading the carriage 31 with the ribbon cassette, in which the ink ribbon for OHP sheet is located, and the winding bobbin 37 as well as the winding shaft 33 are moved downward against the energizing force of the pushing up spring 35. The winding shaft is kept in the state where it is lowered by loading the carriage 31 with the ribbon cassette and securing the latter to the former. Just as for the ink ribbon for plain paper, when the driving gear 44 is rotated by the ribbon winding motor 42, since the winding shaft 33 is kept in the state where it is lowered, the winding auxiliary transmission gear 47 stated above is engaged with the winding gear for OHP sheet 37 and in this way the winding gear for OHP sheet 37 is driven so as to be rotated. Further, by rotating this winding gear for OHP sheet 37, this rotational driving force is transmitted to the winding shaft 33 through the winding gear for plain paper 36 and two pieces of felt 38 and the winding bobbin 39 stated above is rotated so that the ink ribbon for OHP sheet is rewound. At this time, since the rotational force of the winding gear for OHP sheet 37 is transmitted through the two pieces of felt 38, it is possible to reduce the winding torque with respect to that required in the case where the winding gear for plain paper 36 is driven so as to be rotated through a piece of felt 38.

On the other hand, in the case where the markers in the ink ribbon are detected, the ribbon winding motor 42 is driven so as to be rotated in the reverse direction so that the driving gear 44 is driven so as to be rotated in the direction indicated by arrow B in FIG. 4. At the same time, the pivoting arm 46 is pivoted clockwise. Thus, the engagement of the winding auxiliary transmission gear 47 with the winding gear is removed and the detection driving auxiliary transmission gears 48*b* stated above is engaged with the detection driving gear 34. In this way, the detection driving gear 34 is driven directly so as to be rotated through the main transmission gear 45 as well as the detection driving auxiliary transmission gear 48*a* and 48*b* so that the winding bobbin 39 is rotated to detect the predetermined markers in the ink ribbon.

Consequently, in the present embodiment, in the case where the ink ribbon for plain paper or the ink ribbon for OHP sheet is rewound, since the winding torque thereof can be varied, it is possible to effect the winding suitably, depending on the kind of the ink ribbon, and to intend to improve the quality of the printing.

Further, in the case where the markers in the ink ribbon are detected, since the rotational force is transmitted directly from the ribbon winding motor 42 to the winding shaft 33, even if a rotation load is imposed on the ink ribbon, the winding shaft 33 never slips and therefore it is possible to prevent the generation of fluctuation in the rotation of the winding shaft 33 and to detect surely the markers in the ink ribbon.

Although, in the embodiment as described above, the winding shaft 33 is disposed in the vertical direction, it may be disposed in the horizontal direction at need.

Further, a driving mechanism such as an electromagnetic solenoid, etc. may be used for the movement of the winding shaft 33 in the axial direction.

In addition, the present invention is not restricted to the embodiments described above, but various modifications may be possible at need.

As explained above, in the ink ribbon winding mechanism, according to the present invention, since the predetermined markers of the ink ribbon are detected while rotating the winding bobbin by transmitting the rotational driving force of the ribbon winding motor directly to the detection driving gear, even if a rotational load is imposed on the ink ribbon, the winding shaft never slips and therefore it is possible to prevent the generation of fluctuations in the rotation of this winding shaft. As the result, the movement speed of the markers in the ink ribbon is never varied and thus it is possible to detect appropriately and surely the markers stated above and to obtain good color printing.

We claim:

1. An ink ribbon winding mechanism for use with an ink ribbon cassette having a winding hole formed therein, said winding mechanism comprising:
   - a winding bobbin insertable in said winding hole of said ribbon cassette;
   - a winding shaft secured to said bobbin, said winding shaft including a detection driving means;
   - a winding driving means coupled to said winding shaft;
   - a slipping means positioned to provide frictional contact between said winding driving means and said detection driving means, wherein said slipping means transfers movement of said winding driving means to said detection driving means;
   - a ribbon winding driving source for providing a rotational driving force; and
   - a transmission means for selectively transmitting said rotational driving force of said ribbon winding driving source to either said winding driving means or to said detection driving means.

2. An ink ribbon winding mechanism according to claim 1, wherein said winding driving means is a gear, and said detection driving means is a gear, and further wherein said transmission means comprises a pivoting arm and having a plurality of gears mounted thereon.

3. An ink ribbon winding mechanism according to claim 2, wherein said pivoting arm has an arc shape.

4. An ink ribbon winding mechanism according to claim 1, wherein said driving source is a motor and rotation of said motor in one direction causes said transmission means to engage said winding driving means and rotation of said motor in another direction causes said transmission means to engage said detection driving means.

5. An ink ribbon winding mechanism for use with an ink ribbon cassette having a winding core, said ink ribbon winding mechanism comprising:
   - a winding bobbin engagable with said winding core;
   - a winding shaft secured to said bobbin;
   - a first winding driving means coupled to said winding shaft;
   - a second winding driving means coupled to said winding shaft;

a ribbon winding driving source to e rotated;

a detection driving means secured to said winding shaft;

a slipping mechanism positioned between said first winding driving means and said second winding driving means, and between said second winding driving means and said detection driving means;

a transmission means for selectively transmitting a rotational force of said winding driving source to said first or second winding driving means, or to said detection driving means at the detection of markers formed in said ink ribbon;

wherein said winding shaft is movable in an axial direction to permit said transmission means to engage selectively with said first winding driving means or with said second winding driving means.

6. An ink ribbon winding mechanism according to claim 5, wherein said first winding driving means is a gear, said second winding driving means is a gear, said detection driving means is a gear, and said transmission means comprises a pivoting arm having a plurality of gears mounted thereon.

7. An ink ribbon winding mechanism according to claim 5, wherein when said first winding driving means is driven, said winding shaft is located at a first position in said axial direction, and when said second winding driving means is driven, said winding shaft is located at a second position in said axial direction.

8. An ink ribbon winding mechanism according to claim 7 wherein said first position results in a first rotational force on said first winding driving means and said second position results in a different rotational force on said second winding driving means.

* * * * *

UNITED STATES PATENT AND TRADEMARK OFFICE

CERTIFICATE OF CORRECTION

PATENT NO. : 5,096,315
DATED : March 17, 1992
INVENTOR(S) : Yamamoto et al.

It is certified that error appears in the above-identified patent and that said Letters Patent is hereby corrected as shown below:

ON THE TITLE PAGE

In the Abstract:

Line 15 - delete "detetion" and insert --detection--.

Column 9 line 1 - delete "e" and insert --be--.

Signed and Sealed this

Thirty-first Day of August, 1993

Bruce Lehman

*Attest:*

BRUCE LEHMAN

*Attesting Officer*

*Commissioner of Patents and Trademarks*